US007832224B2

(12) United States Patent
Roo et al.

(10) Patent No.: US 7,832,224 B2
(45) Date of Patent: Nov. 16, 2010

(54) APPARATUS AND METHOD FOR CONTROLLING LAMP OF REFRIGERATOR

(75) Inventors: Jin Sug Roo, Changwon (KR); Jai Hwan Shim, Busan (KR); Sang Su Lee, Changwon (KR)

(73) Assignee: LG Electronics Inc., Seoul (KR)

( * ) Notice: Subject to any disclaimer, the term of this patent is extended or adjusted under 35 U.S.C. 154(b) by 134 days.

(21) Appl. No.: 11/510,736

(22) Filed: Aug. 28, 2006

(65) Prior Publication Data

US 2007/0044497 A1 Mar. 1, 2007

(30) Foreign Application Priority Data

Aug. 29, 2005 (KR) ..... 10-2005-0079575
Dec. 12, 2005 (KR) ..... 10-2005-0122045
Jan. 25, 2006 (KR) ..... 10-2006-0007863

(51) Int. Cl.
*F25D 23/00* (2006.01)

(52) U.S. Cl. ..... 62/264; 62/246; 62/249; 312/223.5; 362/92; 362/94; 362/127; 362/133

(58) Field of Classification Search ..... 62/249, 62/264, 246; 312/223.5, 84; 362/127, 133, 362/92, 94
See application file for complete search history.

(56) References Cited

U.S. PATENT DOCUMENTS 4,712,591 A * 12/1987 McCann et al. ..... 141/88
4,851,662 A * 7/1989 Ott et al. ..... 250/214 AL
5,578,978 A * 11/1996 Zoerner ..... 335/239
6,115,485 A 9/2000 Dumoulin et al. ..... 382/128
6,679,082 B1 * 1/2004 Tunzi ..... 62/344
6,804,974 B1 * 10/2004 Voglewede et al. ..... 62/264
7,032,780 B2 4/2006 Crisp, III ..... 222/129.1
7,040,110 B2 * 5/2006 Nowak ..... 62/264
7,340,914 B2 * 3/2008 Bowen et al. ..... 62/389
7,411,195 B2 8/2008 Narasako et al. ..... 250/338.3
7,568,358 B2 8/2009 Wetekamp ..... 62/126
2004/0012314 A1 * 1/2004 Hay et al. ..... 312/405.1

FOREIGN PATENT DOCUMENTS

KR 10-1998-0003415 3/1998
KR 20-0167164 5/2000
KR 2005-010274 7/2003
KR 10-2004-0084297 10/2004
KR 10-2005-0070815 7/2005

OTHER PUBLICATIONS

Mexican Office Action dated Aug. 17, 2009.

(Continued)

*Primary Examiner*—Cheryl J Tyler
*Assistant Examiner*—Justin Loffredo
(74) *Attorney, Agent, or Firm*—KED & Associates, LLP

(57) ABSTRACT

An apparatus is provided for controlling a lamp of a refrigerator. The apparatus may include a dispenser provided on a refrigerator door and a lamp installed within the dispenser for illuminating the dispenser. The dispenser may include a rotary member that rotates as an operation lever provided in the dispenser is operated and a duct door for selectively opening and closing an ice duct. The rotary member may include a rotary shaft supported by side walls of the dispenser and a connector part that extends from the rotary shaft. The duct door may be coupled to the connection part.

19 Claims, 12 Drawing Sheets

OTHER PUBLICATIONS

Office Action dated Nov. 12, 2009 for U.S. Appl. No. 12/264,632.
Mexican Office Action dated Sep. 8, 2009.
Mexican Office Action dated Dec. 7, 2009.
Office Action dated Apr. 27, 2010 from U.S. Appl. No. 12/264,632.

* cited by examiner

APPARATUS AND METHOD FOR CONTROLLING LAMP OF REFRIGERATOR

BACKGROUND OF THE INVENTION

1. Field of the Invention

The present invention relates to a refrigerator, and in particular to an apparatus and a method for controlling the backlight of a dispenser and a function button array of a refrigerator.

2. Description of the Prior Art

In general, a refrigerator is an apparatus for generating cool air using the phase change of a cooling medium, thereby maintaining a predetermined low-temperature condition. Due to the improvement of living level and consumers' tastes preferring multi-functional and large-sized products, refrigerators are gradually getting larger in size. Consequently, two-door refrigerators (or side-by-side refrigerators), which have a large capacity, have been recently fabricated.

A dispenser is provided on the front side of a door of such a two-door refrigerator, which allows ice or water within the refrigerator to be dispensed without opening the door. The dispenser prevents cool air within the refrigerator from being discharged to the outside of the refrigerator, because the dispenser allows a user to receive ice or water through it without opening the door.

FIG. 1 shows a perspective view of a refrigerator having a dispenser as described above.

As shown in the drawing, a refrigerator body 1 having a reservoir within the inside thereof has a freezing chamber door 3, which is provided on a half-part of the refrigerator body 1. Because one end of the freezing chamber door 3 is rotatable about the other end thereof, the door 3 functions to open or close the reservoir.

The freezing chamber door 3 is provided with a dispenser 5. The dispenser 5 has a recess 7, which is depressed so that an ice receptacle, a cup or the like can be received in the recess 7. On the rear side of the recess 7, there is provided an operation lever 8, which is operated by an ice receptacle or the like so as to adjust the amount of ice or water to be discharged.

In addition, above the recess 7, there are provided a display unit 10 for displaying the operating condition of the refrigerator, and an operating panel 13 having a manipulation button array 11 for controlling the operation of the refrigerator or the like.

With the above-mentioned arrangement, when a user positions an ice receptacle or a cup in the recess 7 in a state in which the freezing chamber door 7 is closed and then presses the operation lever 8 backward, a predetermined amount of ice or water will be discharged depending on the pressing action upon the operation lever 8.

However, according to the prior art, if the user wishes to receive ice or water through the dispenser 5 in the dark of nighttime, there is a problem in that the user cannot recognize the amount of ice or water with the naked eye. Therefore, when the user receives ice or water through the dispenser, there will be unnecessary inconvenience in that the user should turn on a light fixture.

In addition, when the peripheral area of the refrigerator is very dark, it is difficult to correctly use the dispenser 5 because it is substantially impossible to find the correct position of the dispenser 5.

Accordingly, the present invention has been made to solve the above-mentioned problems occurring in the prior art, and an object of the present invention is to provide an apparatus and a method for controlling a lamp in a refrigerator, which allows a user to correctly receive ice or water through a dispenser without turning on a lighting fixture.

Another object of the present invention is to provide an apparatus and a method for controlling a lamp of a refrigerator which control the on/off operation of the lamp by comparing the current luminous intensity of the peripheral area of a refrigerator with a reference luminous intensity, which is variable.

Another object of the present invention is to provide an apparatus and a method for controlling a lamp of a refrigerator, which allow a user to recognize information concerning the luminous intensity of the peripheral area of the refrigerator.

Still another object of the present invention is to provide an apparatus and a method for controlling a lamp of a refrigerator, which control backlights of a dispenser and a manipulation button array positioned on a front panel.

In order to achieve the above-mentioned objects, according to an aspect of the present invention, there is provided an apparatus for controlling a lamp of a refrigerator, including: a dispenser provided on a refrigerator door; at least one lamp installed within the dispenser for illuminating the dispenser; and a control unit for controlling the on/off operation of the at least one lamp.

The dispenser may include: a rotary member which rotates by a predetermined angle as an operation lever provided in the dispenser is operated; and a duct door for selectively opening and closing an ice duct, through which ice is discharged when the rotary member is rotated. It is preferable that the dispenser further includes a guide member for guiding the ice, the guide member being formed from a transparent material.

The lamp may be fixedly installed on a surface of the rotary member so as to illuminate the inner side of the dispenser when the duct door closes the ice duct. In addition, a rotation restraint piece may be provided on a surface of the duct door in such a manner as to extend outward farther than the lamp in order to prevent the fracture of the lamp when the door duct is opened.

The control unit controls the on/off operation of the lamp depending on the operation of a manipulation button array provided in the dispenser.

The control unit also controls the on/off operation of the lamp when the operation lever is operated.

According to another aspect of the present invention, there is provided an apparatus for controlling a lamp of a refrigerator, including: at least one lamp for illuminating a dispenser provided on a refrigerator door; a sensor formed on the front surface of the refrigerator or within the dispenser for measuring the surrounding brightness; and a control unit which compares the measured luminous intensity and a previously set reference luminous intensity and controls the brightness of the lamp according to the result of the comparison.

Here, the apparatus may further include a display unit for displaying the measured luminous intensity and/or the reference luminous intensity, a memory unit for storing the reference luminous intensity, and a manipulation button array for renewing the reference luminous intensity.

In addition, the reference luminous intensity is a reference value for lightening the lamp, which may be increased or decreased by a predetermined increment.

The reference luminous intensity and the measured luminous intensity may be indicated by numerical characters, graphs, geometrical figures, or a combination thereof.

According to another aspect of the present invention, there is also provided an apparatus for controlling a lamp of a refrigerator, including: a dispenser provided in a refrigerator door; a lamp positioned in a recess of the dispenser for illuminating the recess with a brightness corresponding to an input of a power source voltage; a lamp driving unit for supplying the power source voltage corresponding to a driving control signal; a sensor for sensing the surrounding brightness of the refrigerator; and a control unit which is capable of varying the driving control signal in such a manner that the brightness of the lamp is changed in response to the output of the sensor.

Here, the apparatus may further include a button lamp positioned behind a manipulation panel which is provided with a manipulation button array for manipulating the operation condition of the refrigerator, wherein the button lamp illuminates the manipulation panel with a predetermined level of luminous intensity, and a living organism sensor, such as a remote infrared sensor or a pyroelectric sensor, for sensing heat emanating from a human body so as to detect whether living organisms exist around the refrigerator.

It is preferable that the lamp and the button lamp are connected to the output of the lamp driving unit in parallel and concurrently controlled when the operation lever or the manipulation button array is operated.

In addition, a light guide plate may be interposed between the button lamp and the manipulation button array so as to guide light projected from the button lamp to a wide area.

The driving control signal produced by the control unit may include a first driving mode for lightening the lamp and/or the button lamp with the minimum brightness, a second driving mode for lightening the lamp and/or the button lamp with the maximum brightness, a third driving mode for rendering the lamp and/or the button lamp to be reduced in brightness from a maximum brightness to a minimum brightness during a predetermined length of time, and a fourth driving mode for rendering the lamp and/or the button lamp to be reduced in brightness from a maximum brightness to an off status during a predetermined length of time.

According to another aspect of the present invention for achieving the above-mentioned objects, there is provided a method for controlling a lamp of a refrigerator, including steps of: comparing a previously set reference luminous intensity and a surrounding brightness; turning on at least one lamp for illuminating a dispenser provided on a refrigerator door when it is determined that the surrounding brightness is equal to or lower than the reference luminous intensity as the result of the comparison.

The method may further include step of displaying at least one of the reference luminous intensity and the surrounding intensity.

When a demand of changing the reference luminous intensity is made, the reference luminous intensity is changed by being increased or decreased by a predetermined increment, and when the demand of changing the reference luminous intensity is made, the reference luminous intensity is displayed after the predetermined increment of increase or decrease is applied to the reference luminous intensity, so that the changed reference luminous intensity is confirmed in comparison to the surrounding brightness.

The comparison between the reference luminous intensity and the surrounding brightness is executed when an operation lever is operated, the operation lever being provided in the dispenser.

In addition, according to another aspect of the present invention, there is provided a method for controlling a lamp of a refrigerator, including steps of: driving the lamp with a minimum luminous intensity corresponding to the surrounding brightness of the refrigerator; driving the lamp with a maximum luminous intensity in response to the detection of a user approaching the refrigerator or the operation of an operation lever provided on a dispenser of the refrigerator; and controlling the brightness of the lamp in such a manner that the lightened lamp is gradually darkened to the minimum brightness during a predetermined length of time in response to the release of the operation lever.

In the lamp brightness controlling step, the effective voltage of the power source inputted into the lamp is gradually reduced.

The method may further include step of detecting the conditions of nighttime and daytime in response to the output of an illumination sensor for sensing the surrounding brightness of the refrigerator. If the operation lever is operated when the nighttime condition is detected in the detecting step, the lamp is driven with the maximum brightness, and when the operation lever is released, the lightened lamp is gradually darkened to the minimum brightness and then turned off during a predetermined length of time.

The minimum brightness includes the turned-off condition of the lamp.

According to the present invention configured as described above, because a predetermined level of illumination is provided from at least one lamp when ice/water is dispensed from the dispenser, the dispenser is easy to use. In addition, because the lamp is turned on depending on the result of the comparison between the surrounding brightness of the dispenser and a previously set reference luminous intensity, the reference luminous intensity being changeable, the condition for turning on the lamp can be controlled according to the surrounding environment or user's taste. In addition, the brightness of the lamp can be tuned.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE PREFERRED EMBODIMENTS

Figure 1:
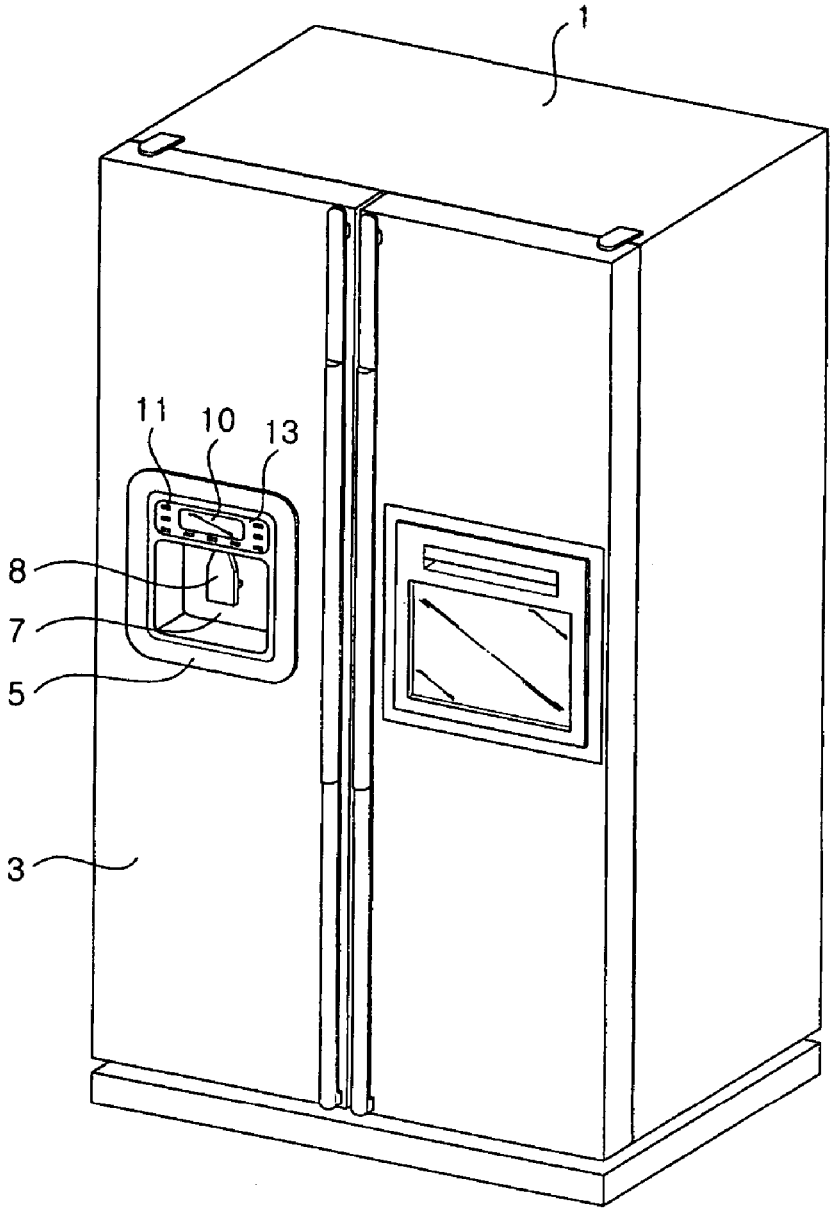
FIG. 1 is a perspective view of a refrigerator provided with a conventional dispenser.

Hereinafter, a preferred embodiment of the present invention will be described with reference to the accompanying drawings. In the following description and drawings, the same reference numerals are used to designate the same or similar components.

Figure 2:
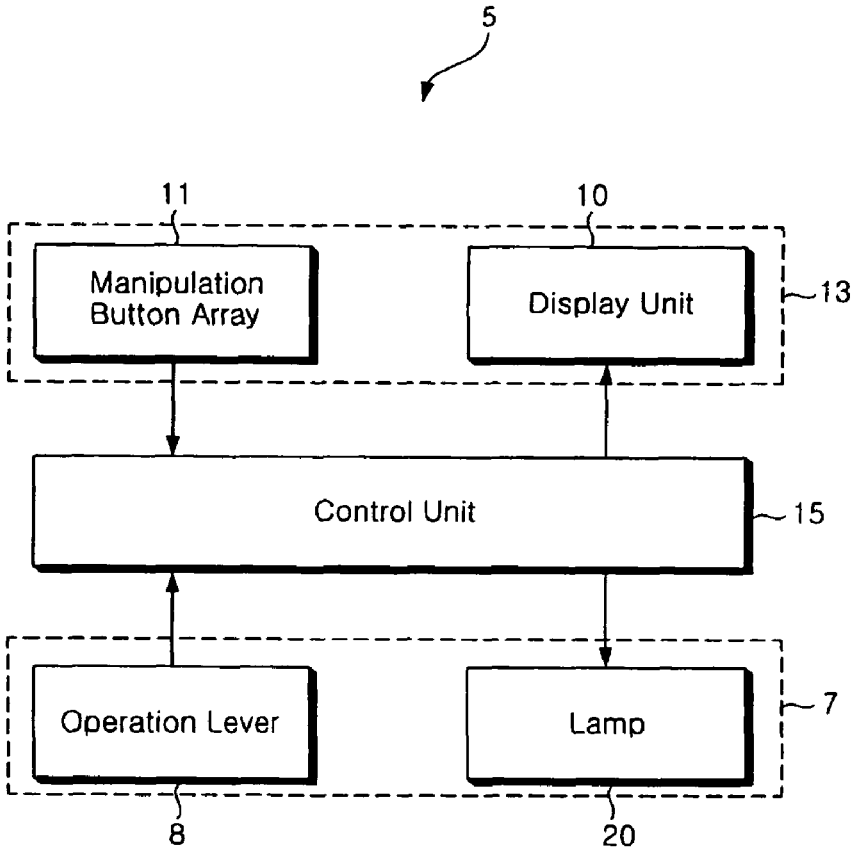
FIG. 2 is a block diagram of a lamp control apparatus of a refrigerator according to a first embodiment of the present invention.
Figure 3:
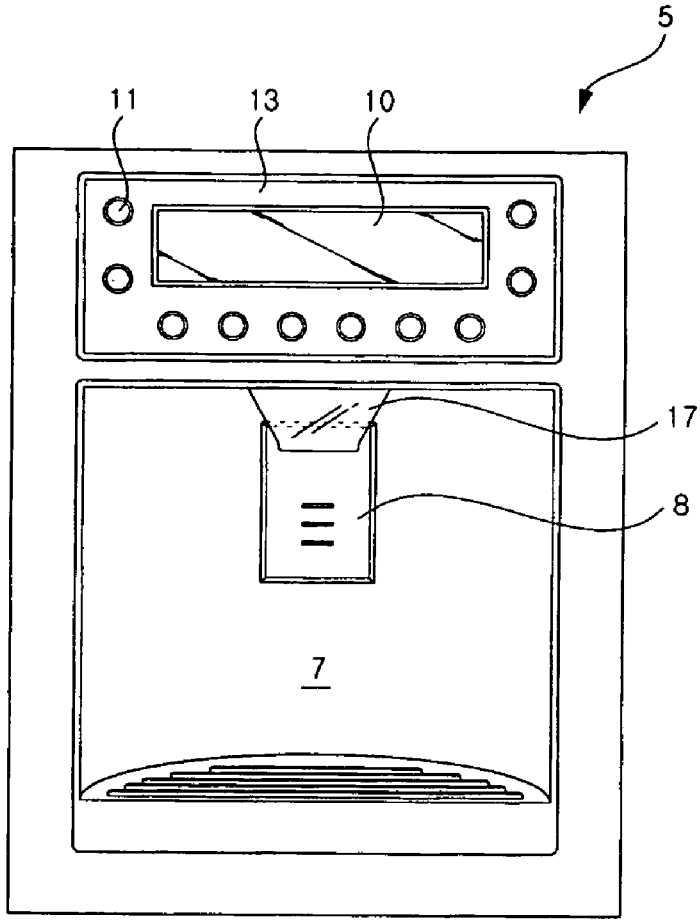
FIG. 3 is a front view of the dispenser of FIG. 2.
Figure 4A:
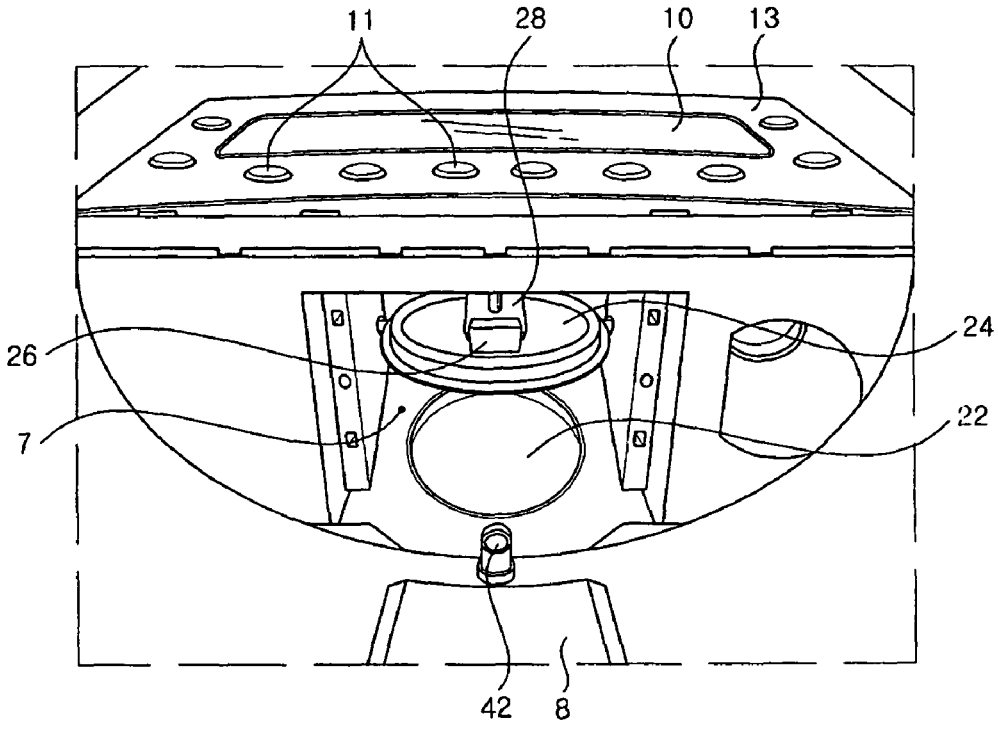
FIGS. 4*a* and 4*b* are bottom side perspective views showing a duct door mounted with a lamp in opened and closed states, respectively, in a state in which the guide member shown in FIG. 3 is removed.
Figure 4B:
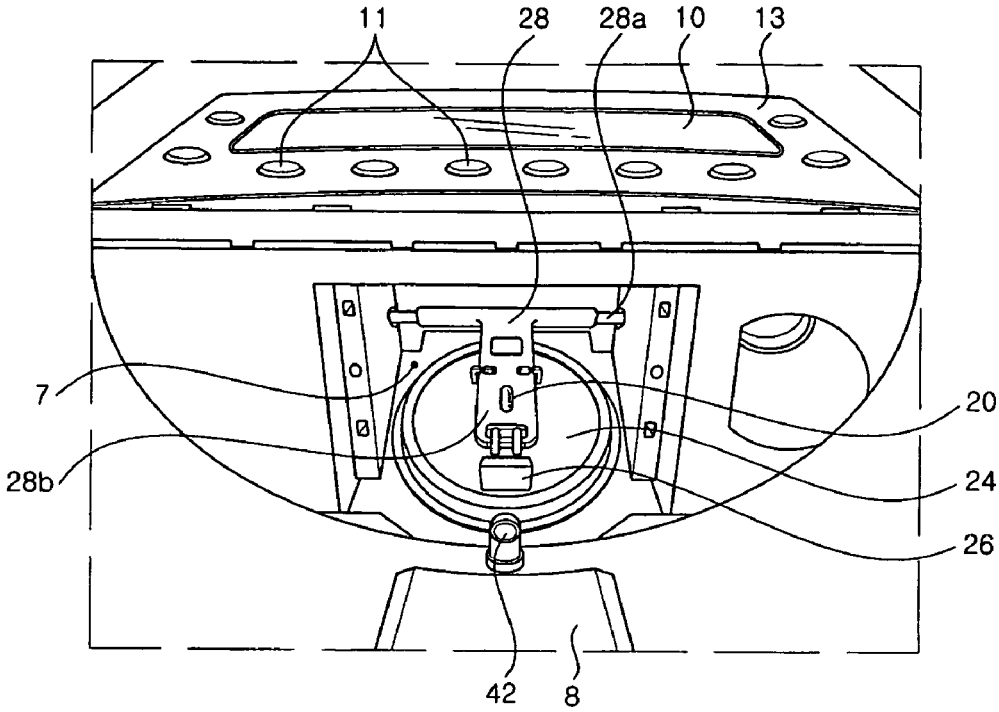

FIG. 2 is a block diagram of a lamp control apparatus of a refrigerator according to a first embodiment of the present invention, FIG. 3 is a front view of the dispenser of FIG. 2, and FIGS. 4*a* and 4*b* are bottom side perspective views showing a duct door mounted with a lamp in opened and closed states, respectively, in a state in which the guide member shown in FIG. 3 is removed.

At first, description is made with reference to FIGS. 2 and 3. A dispenser 5, which is installed in the front side of a freezing chamber door so as to allow ice or water to be dispensed without opening the freezing chamber door, is provided with a recess 7. The recess 7 is provided with an operation lever 8 which is operated as being pressed by an ice receptacle, a cup or the like, thereby adjusting the discharge amount of ice or water. In addition, a lamp 20 (see FIG. 4) is fixedly installed on a side of a rotary member 28, which will be described later, in such a manner as to illuminate the recess 7.

Above the recess 7, there are provided a display unit 10 for displaying the operating condition of the refrigerator and a manipulation panel 13 having a manipulation button array 11, which allows the user to selectively manipulate the dispenser 5.

There is provided a control unit 15 which controls the display unit to display information for one or more concerned functions when the manipulation button array 11 is manipulated, and controls the ON/OFF operation of the lamp 20 when the manipulation button array 11 on the manipulation panel 13 and/or the operation lever 8 are operated. In addition, when the operation lever 8 is operated, the control unit 15 also functions to cause the rotary member 28 to be swiveled in a direction, so that an ice duct 22 is opened by a duct door 24. The control unit 15 may be a central process unit (CPU) for controlling the entire function of the refrigerator or a control unit for controlling the function of the dispenser 5.

A guide member 17 in a funnel shape is provided on the upper side of the recess 7 so as to discharge ice or water. The guide member 17 is preferably formed from a transparent material. This is to allow a light path from the lamp 20 installed in the dispenser 5 to not be blocked by the guide member 17. Therefore, if the lamp 20 is turned on, the light is diffused over a wide area without being blocked by the guide member 17, thereby illuminating the recess 7. It is optional to provide such a guide member 17.

Next, FIGS. 4*a* and 4*b* are bottom side perspective views showing a duct door mounted with a lamp in opened and closed states, respectively, in a state in which the guide member shown in FIG. 3 is removed.

Referring to the drawings, there is provided a duct door 24, which allows the ice duct 22 to be opened or closed, wherein the ice duct 22 discharges and transfers the ice produced in an ice-maker (not shown) to the guide member 17. The duct door 24 is formed in a shape corresponding to the ice duct 22. The duct door 24 has a rotary member 28 at a side thereof, so that the duct door 24 is capable of swiveling according to the control operation of the control unit when the operation lever 8 is operated. The rotary member 28 is formed substantially in a "T" shape, and consists of a rotary shaft 28*a* rotatably supported by both side walls of the dispenser 5, and a connection part 28*b* for connecting the duct door 24 to the rotary shaft 28*a*.

The opposite ends of the rotary shaft 28*a* of the rotary member 28 are inserted into and rotatably supported by both inside walls of the dispenser 5 and connected to a solenoid valve (not shown) which is driven according to the control action of the control unit 15. If the solenoid valve is driven, the duct door 24 connected with the rotary member 28 is rotated in a predetermined direction. At this time, it is natural that the duct door 24 can completely open the ice duct 22. That is, the solenoid valve should smoothly open or close the duct door 24 with the aid of the rotary member 28, more preferably, the solenoid valve should open or close the duct door 24 while controlling the rotating range of the duct door 24.

Here, the duct door 24 may be removably combined with the rotary member 28. This is to allow only the door 24 to be separated so as to facilitate the washing of the duct door or the replacement of the lamp 20 with a new one. For the removable construction, various features such as screws or insertion means can be applied.

A rotation restraint piece 26 is provided at a side of the duct door connected with the rotary member 28. The rotation restraint piece 26 extends higher than the height of the lamp 20, so that when the duct door 24 is continuously rotated, the rotation restraint piece 26 serves to prevent the lamp from being fractured as a result of forced contact contacted with the ceiling of the recess 7. This case corresponds to the case in which the lamp 20 projects from a side of the rotary member 28. If the lamp 20 is inserted into a side of the rotary member 28, the lamp can be protected even if the rotation restraint piece 26 is not provided.

The lamp 20 provided on the rotary member 28 may consist of a conventional electric bulb, an LED, or a combination thereof. Of course, any other light source may be employed as the lamp if it is capable of emitting light with a proper size to be installed on the rotary member 28. Here, although it is described that the lamp 20 is installed on the rotary member 28, it is also possible to position the lamp within a water-tight cover (not shown) for protecting the lamp 20 from moisture, and to then install the water-tight cover on the rotary member 28. In addition, the lamp 20 may be installed any place if the lamp 20 is capable of entirely illuminating the recess 7 when the duct door 24 is closed. For example, the lamp 20 may be provided on an inner surface of the recess 7 or on a side of the duct door 24 joined with the rotary member 28.

Meanwhile, the lamp 20 is connected with the control unit 15 which controls the operation of the dispenser 5. A manipulation button array 11 for operating the lamp 20 may be provided on the manipulation panel 13. As such, the user may selectively turn on or turn off the lamp by manipulating the manipulation button array 11. In addition, it is also possible to render the lamp 20 to be turned on or turned off when the operation lever 8 is operated. In other words, the control unit 15 renders the lamp 20 to be turned on either when the button 11 provided on the manipulation panel 13 is manipulated or when the operation lever 8 is operated. Further, it is also possible for the lamp 20 to be automatically turned on or off by the control unit 15 when a cup is put into or taken out from the recess 7.

Such a turning-on operation of the lamp 20 will provide illumination, which allows the user to confirm whether ice or water is discharged through the dispenser 5 even during the nighttime.

As such, the user may easily put a cup into the recess 7 when the lamp 20 is turned on. In addition, if the operation lever 8 is operated by the cup, the control unit 15 receives an operation signal from the operation lever 8 and controls the driving of the solenoid valve in such a manner that ice selected through the manipulation button array 11 can be discharged. Consequently, the duct door 24 is rotated together with the rotary member 28, thereby opening the ice duct 22. If the discharge of water is selected, the control unit 15 makes water discharged through a water outlet 42 without driving the solenoid valve.

The first embodiment of the present invention as described above is advantageous in that ice or water can be smoothly dispensed as the dispenser 5 is illuminated and the external appearance of the refrigerator is pleasing to the eye as the guide member 17 for guiding the discharged ice is formed from a transparent material and the recess 7 is entirely illuminated.

Next, according to a second embodiment of the present invention, the turning-on of the lamp provided on the dispenser of the refrigerator is controlled by comparing the current luminous intensity with a presetted reference luminous intensity.

Figure 5:
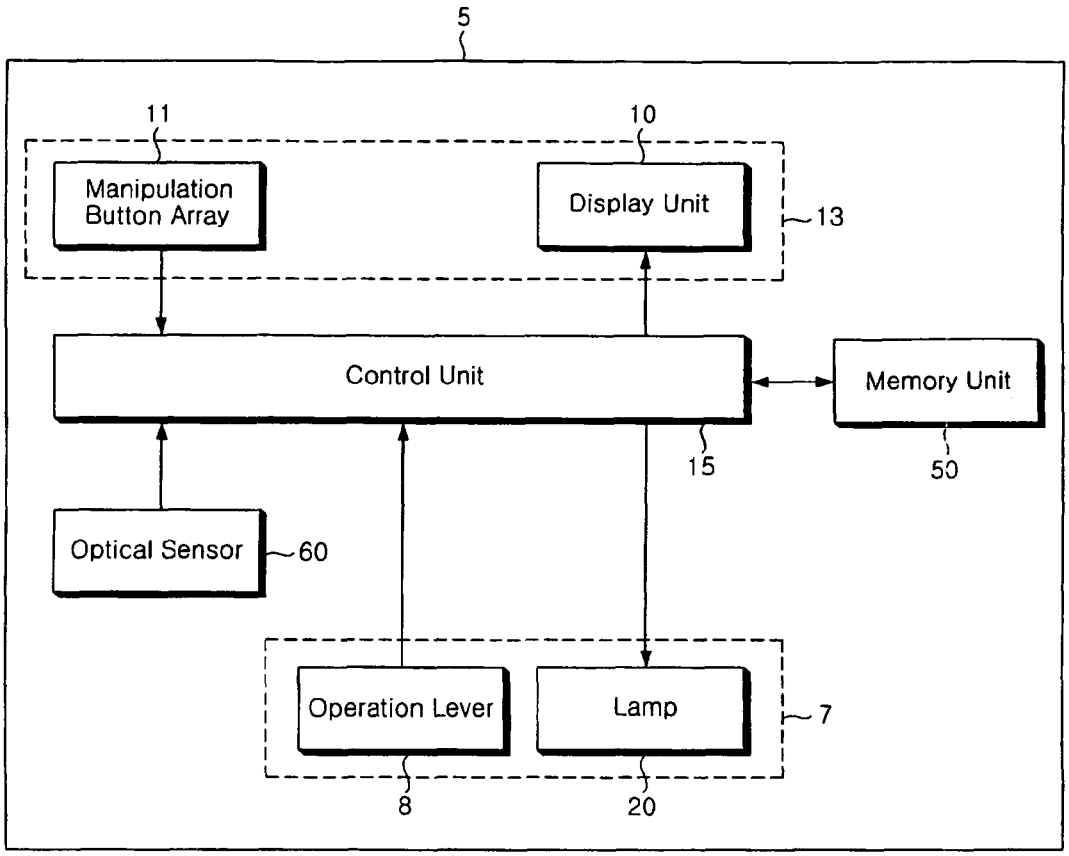
FIG. 5 shows a block diagram for controlling a lamp of a refrigerator depending on a luminous intensity according to a second embodiment of the present invention.
Figure 6A:
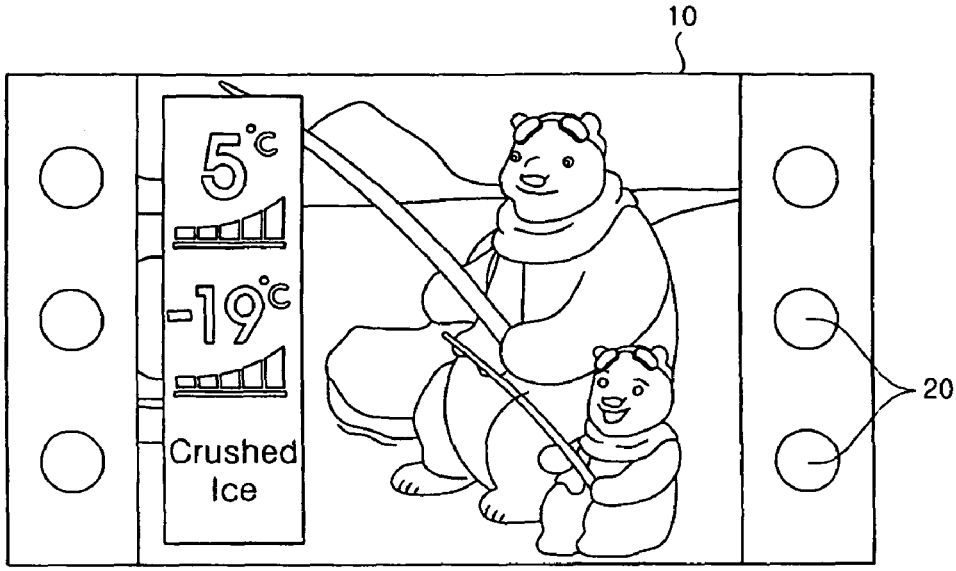
FIGS. 6*a* and 6*b* are exemplified views showing one day's schedule information and sensed luminous intensity/reference luminous intensity information, respectively.
Figure 6B:
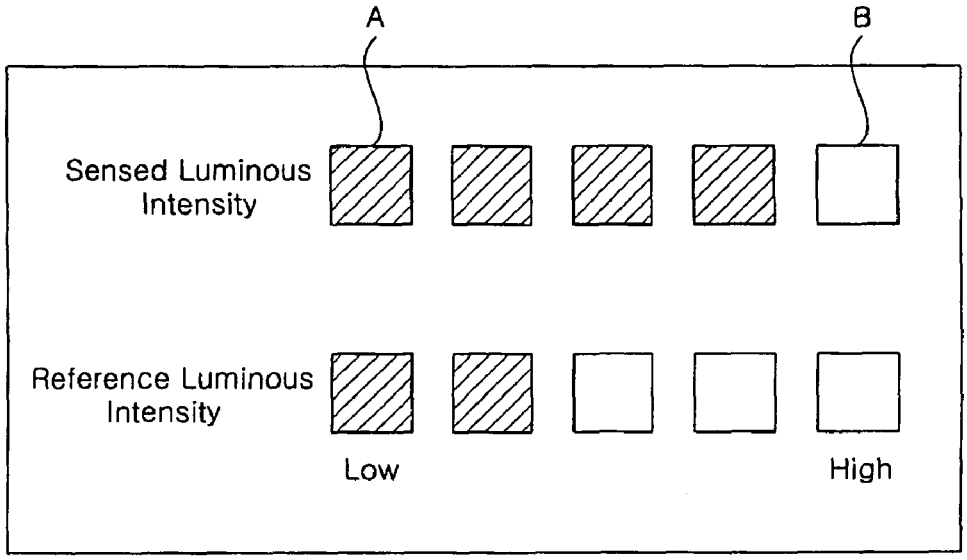
Figure 7:
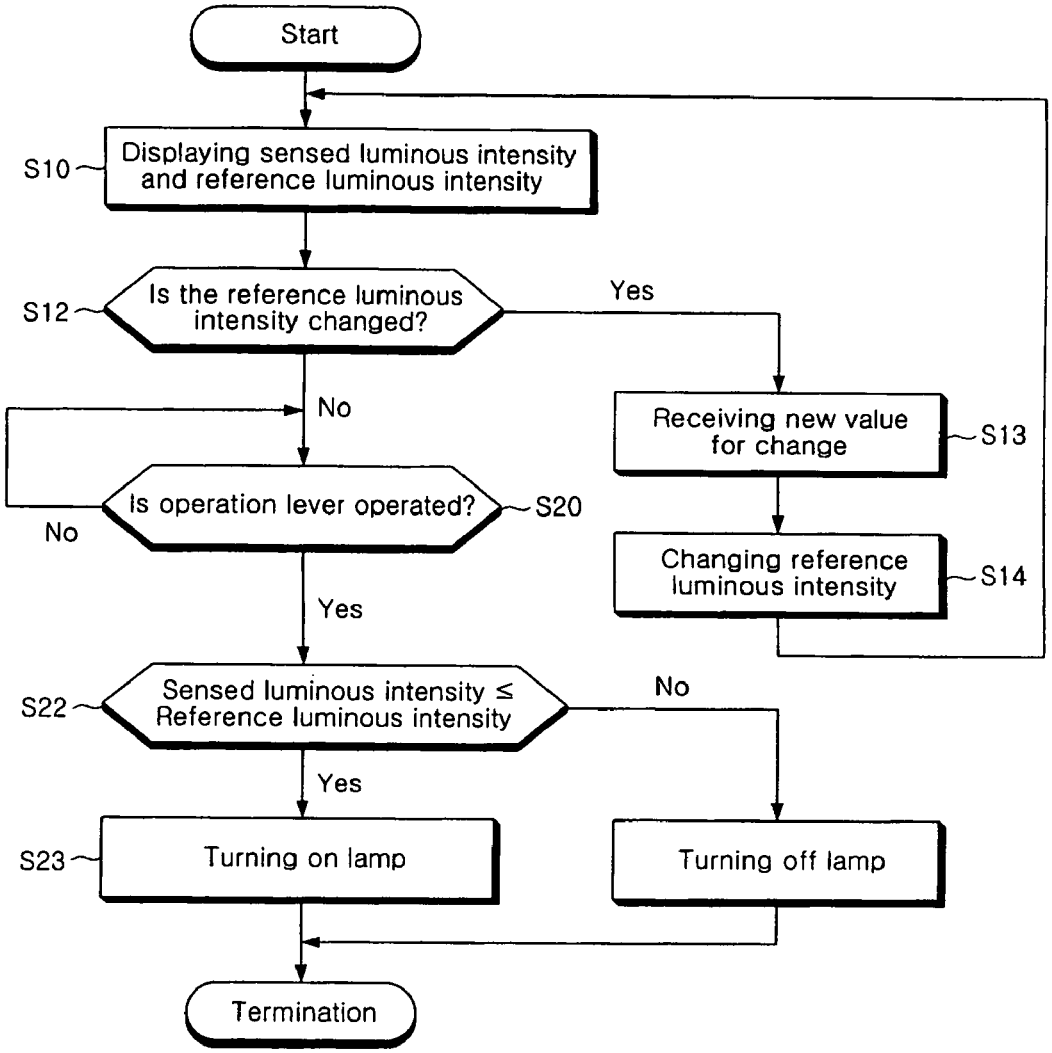
FIG. 7 is a flowchart for controlling the luminous intensity of the lamp of the refrigerator according to the second embodiment of the present invention.

FIG. 5 shows a block diagram for controlling the lamp of the refrigerator depending on luminous intensity according to the second embodiment of the present invention, FIGS. 6*a* and 6*b* are exemplified views showing one day's schedule information and sensed luminous intensity/reference luminous intensity information, respectively, and FIG. 7 is a flowchart for controlling the luminous intensity of the lamp of the refrigerator according to the second embodiment of the present invention.

Referring to these drawings, as in first embodiment described above, a dispenser 5, which allows ice or water to be dispensed without opening the freezing chamber door, is provided with a recess 7. The recess 7 is provided with an operation lever 8, which is pressed by an ice receptacle or a cup so as to control the discharge of ice or water. In addition, a lamp 20 is provided on a predetermined position in the recess 7.

Above the recess 7, there is provided a display unit 10 for displaying the operating condition of the refrigerator. As shown in FIG. 6*a,* it is preferable that the display unit 10 is a color type thin film transistor liquid crystal display (TFT LCD), so that it displays a user interface, an avatar having various forms, appearances and/or actions, information concerning the refrigerator (for example, set temperatures of the freezing chamber and the refrigerating chamber, and the service type of the dispenser such as water-dispensing, crushed ice-dispensing, or cubic ice-dispensing), and light information (for example, measured luminous intensity and reference luminous intensity). The user interface may be the background, on which the avatar is displayed. In addition, FIG. 6*b* shows a sensed luminous intensity and a reference luminous intensity displayed on the display unit 10.

A manipulation button array 11 may be provided so as to allow the user to selectively control the condition of the inside of the refrigerator or the dispenser 5. The manipulation button array 11 is input means, through which the user may input commands (for example, selecting the service type of the dispenser, changing the set temperatures of the freezing chamber and the refrigerating chamber, changing the reference luminous intensity, displaying the reference luminous intensity and/or the sensed luminous intensity), wherein the manipulation button array 11 is mounted on the front face of the door of the freezing chamber. There may be provided a manipulation button array 11, which may be formed in a button type or touch pad type, wherein the number of manipulation buttons in the manipulation button array 11 may be appropriately determined with reference to various information items to be displayed through the display unit 10.

In addition, a memory unit 50 for storing the current service type of the dispenser 5, background data, measured luminous intensity, reference luminous intensity, etc. is installed within the refrigerator. The memory unit 50 stores background data including an avatar, refrigerator control information, or the like. Here, the background data includes a plurality of avatar character data in the form of still images, moving images or animations. The avatar characters are set by the user or the control unit 15, and a plurality of avatar characters are displayed on the display unit 10 on the basis of the reading of the control unit 15. The refrigerator control information includes set temperatures of the freezing chamber and the refrigerating chamber, the service type of the dispenser 5, etc. In the memory unit 50, light information related to illumination for the dispenser 5 is also stored. The light information includes a reference luminous intensity, which serves as the reference for determining whether to turn on the lamp of the dispenser 5, and a sensed luminous intensity, which is sensed from the inside and/or surrounding (front side) of the dispenser or from the surrounding of the refrigerator. As the unit of the luminous intensity, lux or photo (ph) is used. In the memory unit 50, a changed reference luminous intensity is also stored, wherein the changed reference luminous intensity is changed according to a user's demand for changing the currently set reference luminous intensity, the user's demand being inputted through the manipulation button array 11.

A sensing means is provided for measuring the surrounding brightness of the refrigerator or the dispenser. The sensing means may be an optical sensor 60, for which a photodiode, a phototransistor, a photo IC, a cadmium sulphide (CdS) cell, a photoelectric device, a solar cell, a CCD image sensor, or the like may be employed. The optical sensor 60 may be mounted on various places such as the front face of a refrigerator's door, the inside of the recess 7 of the dispenser 5, the front face of the refrigerator's door adjacent to the dispenser 5, etc in such a manner that the optical sensor can measure the luminous intensity around the optical sensor 60 and supply the measured luminous intensity to the control unit. Therefore, the user may determine the luminous intensity of the inside or surrounding of the dispenser 5 when the dispenser 5 is used.

The control unit 15 is provided in such a manner that the sensed luminous intensity and the reference luminous intensity are simultaneously or separately displayed on the display unit 10. Basically, the control unit 15 receives commands related to the control of the refrigerator through the manipulation button array 11 so as to control the freezing and refrigerating actions, and reads and renders the background data and information related to the condition of the refrigerator from the memory unit 50 to be displayed on the display unit 10. In addition, the control unit 15 renders the sensed luminous intensity from the optical sensor 60, the service information of the dispenser 5, and the reference luminous intensity changed through the manipulation button array 11 to be stored in the memory unit 50.

Next, the action of the second embodiment of the present invention configured as described above is described in detail.

The second embodiment of the present invention allows the change of the previously set reference luminous intensity, wherein the changed reference luminous intensity and the sensed luminous intensity are compared with each other and the lamp 20 is turned on according to the result of the comparison. The change of the reference luminous intensity can be performed by selectively manipulating functionally associated buttons in the manipulation button arrays 11. The change of the reference luminous intensity is made so as to change the time for turning on the lamp 20. For example, if the reference luminous intensity is set as 10 lux, the lamp 20 is caused to be turned on by the control unit 15 only when the sensed luminous intensity is lower than 10 lux. However, it may be occasionally desired to turn on the lamp 20 in an environment darker than the initially set reference luminous intensity (10 lux). In such a case, it is possible to set the reference luminous intensity to be lower than 10 lux.

In step 10, the control unit 15 renders at least one of the sensed luminous intensity and the reference intensity stored in the memory unit 50 to be displayed on the display unit 10. The display is executed using numeral letters, graphs, geometrical figures, or the like, so that the user easily recognizes levels of the sensed luminous intensity and the reference luminous intensity, compares the sensed luminous intensity and the reference luminous intensity, and so on. Here, the sensed luminous intensity may be that received by the control unit 15 from the optical sensor 60 or received and stored in the memory unit 50 by the control unit 15.

In step 12, the control unit 15 determines whether a demand for changing the currently set reference luminous intensity is made by the user through the manipulation button array 11. If such a demand is made ("YES" from the step 12), the control unit 15 receives a new changed value for the reference luminous intensity inputted through the manipulation button array 11 (step 13). The new value may be a value increased or decreased by a predetermined increment as compared with the value of the current luminous intensity, wherein the control unit 15 renders the reference luminous intensity of the new value (which has not been settled yet) to be displayed through the display unit 10, so that the user can confirm and compare the changed reference luminous intensity with the sensed luminous intensity.

If no further changed value is inputted or if the user inputs the termination of change in relation to the reference luminous intensity, the control unit 15 renders the inputted new value to be stored in such a manner as to be referred to as the currently set reference luminous intensity (step 14).

Thereafter, the control unit 15 renders the sensed luminous intensity and the renewed reference luminous intensity to be indicated on the display unit 10.

FIG. 6*b* shows an example of a view displayed on the display unit 10. As shown in the drawing, the sensed luminous intensity and the reference luminous intensity are indicated by using hatched marks and white marks, wherein the luminous intensities becomes lower as approaching the left end and become higher as approaching the right end. Although the control unit 15 may represent the sensed luminous intensity and the reference luminous intensity using numerical characters, it is more preferable to represent the luminous intensities using geometric figures so that they can be visually compared with each other. In addition, the hatched marks A and white marks B are arranged in a predetermined interval (for example, one square indicates a 100 lux interval), and when the reference luminous intensity is changed through the above-mentioned renewal process, the new value for the reference luminous intensity is indicated. It is also possible to indicate the sensed luminous intensity and the reference luminous intensity using numeral characters, wherein the value of the reference luminous intensity may be corrected in units of one (1) lux. The user is allowed to determine how to indicate the luminous intensities.

While the reference luminous intensity is stored as described above, the process for turning on the lamp 20 is executed as the operation lever 8 is operated.

In step 20, when the operation lever 8 is operated, the control unit compares the reference luminous intensity which has been previously stored in the memory unit 50 with the sensed luminous intensity from the optical sensor 60 in step 22. If it is determined that the sensed luminous intensity is equal to or lower than the reference luminous intensity, the control unit 15 renders the lamp 20 to be turned on, so that the inner side and front side of the dispenser 5 have a brightness for allowing the user to conveniently use the dispenser 5 (step 23). However, if it is determined that the sensed luminous intensity is higher than the reference luminous intensity, the control unit 15 keeps the lamp 20 turned off (step 24).

According to the second embodiment of the present invention described above, it will be appreciated that the lighting of the lamp 20 of the dispenser 5 can be controlled depending on a luminous intensity determined according to the surrounding environment or the user's taste because the reference luminous intensity is capable of being changed. In addition, the user can recognize the level of the reference luminous intensity as the currently sensed luminous intensity and the reference luminous intensity are indicated in comparison.

FIGS. 8 to 11 show how to control a refrigerator's lamp according to a third embodiment of the present invention.

Figure 8:
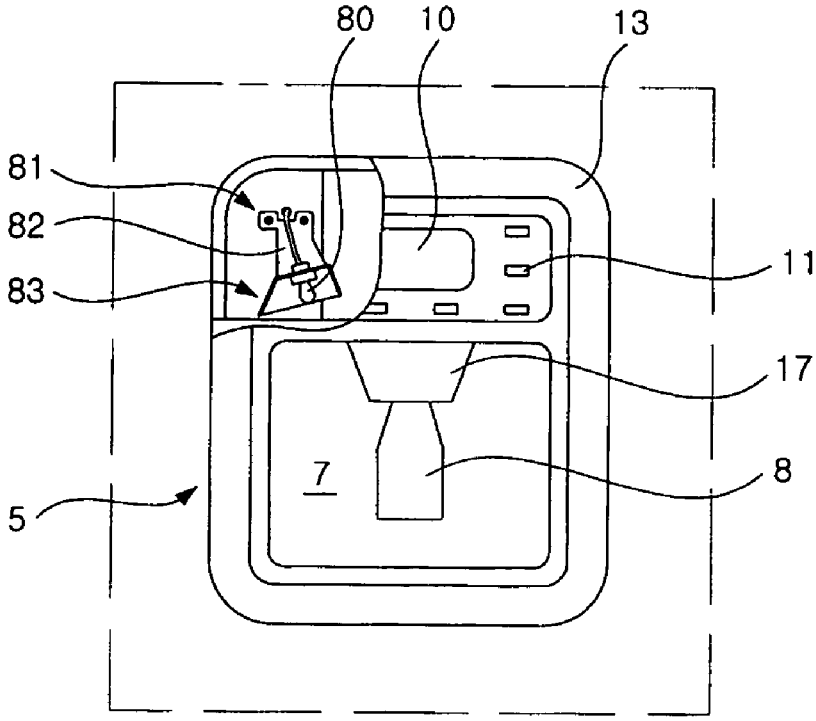
FIG. 8 is a front view showing the construction of a dispenser of a refrigerator according to a third embodiment of the present invention.
Figure 9:
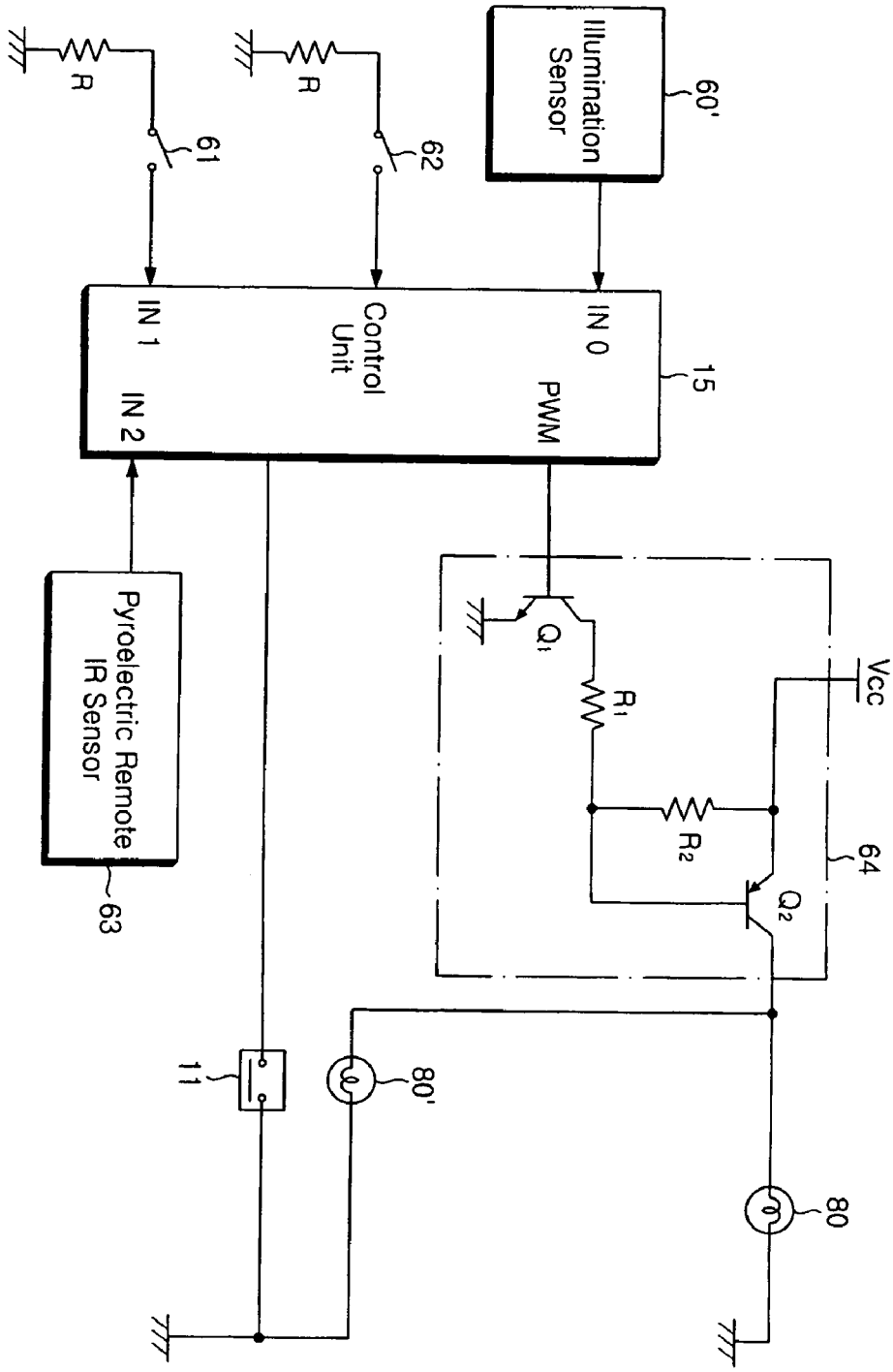
FIG. 9 is a circuit diagram for controlling a lamp and a backlight provided in the dispenser shown in FIG. 8.

FIG. 8 is a front view showing the construction of the refrigerator's dispenser according to the third embodiment of the present invention, and FIG. 9 shows a circuit diagram for controlling the lamp and a backlight which are provided for the dispenser 5 shown in FIG. 8.

Referring to FIGS. 8 and 9, the dispenser 5 has a recess 7. In the recess 7, there are provided an operation lever 8, which is operated by an ice receptacle, a cup or the like so as to adjust the discharged amount of ice or water, and a guide member 1, through which the ice or water is discharged.

Above the recess 7, there are provided a display unit 10 for displaying the operating condition of the refrigerator, and a manipulation panel 13, on which a manipulation button array 11 is provided so as to allow a user to selectively manipulate a fixed condition of the dispenser 5.

A recess lamp 80 for illuminating the recess 7 is provided within the dispenser 5. In addition, a button lamp 80' for illuminating the manipulation panel 13 is provided on the rear side of the manipulation panel 13. The recess lamp 80 is provided as a lamp assembly 81 as shown in FIG. 8. More specifically, the lamp assembly 81 includes the recess lamp 80, a reflector 83 for effectively directing the light from the recess lamp 80 toward the recess 7, and a bracket 82, to which the reflector 83 is joined. Here, although it is described that the two lamps 80 and 80' illuminate the recess 7 and the manipulation panel 13, respectively, it is possible to illuminate them only by the recess lamp 80 which directs light to a light guide plate (not shown) positioned on the lower part of the manipulation panel 13. The recess lamp 80 provides the same function as the lamp 20 of the above-mentioned first and second embodiments.

In addition, there are also provided an illumination sensor 60' for sensing the illumination around the refrigerator and a living organism sensor 63 for detecting the existence of living organisms around the refrigerator. The illumination sensor 60' and the living organism sensor 63 are mounted on the front face of a refrigerator's door or the dispenser 5, so that they can detect the surrounding illumination and the existence of living organisms, respectively.

The third embodiment of the present invention, which employs a pyroelectric remote infrared ray sensor as the living organism sensor 63, is exemplified in FIG. 9.

There are also provided a lever switch 61, which is switched in cooperation with the operation lever 8, and a mode switch 62, which is turned on/off by a user, thereby providing user's input signals corresponding to automatic (nighttime) and manual (daytime) setting conditions, respectively.

The output terminals of the illumination sensor 60', and the pyroelectric remote infrared ray sensor (hereinafter, to be referred to as "pyroelectric sensor"), and one side of each of the lever switch 61, the mode switch 62 and the manipulation button array 11, the other sides of which are grounded, are connected to the input ports of the control unit 15, respectively.

The control unit 15 reads the outputs of the illumination sensor 60' and the pyroelectric sensor, and the switching states of the mode switch 62, the manipulation button array 11 and the lever switch 61. In addition, the control unit 15 outputs a pulse-width modulation (PWM) pulse having logic "high," "low" or a predetermined duty ratio to a lamp driving unit 64 connected to the output port of the control unit 15. As such, the control unit 15 controls the turning-on, turning-off and illumination of the recess lamp 83 and the button lamp 80' connected to the output node of the lamp driving unit 64.

The lamp driving unit 64 includes a driver transistor $Q_2$, the base of which is connected to the collector of a switching transistor Q1, which is switched on/off according to a logic level of a driving control signal, so as to drive the recess lamp 80 and the button lamp 80' with the power source voltage $V_{cc}$ of the emitter, and bias resistors $R_1$ and $R_2$. The lamp driving unit 64 configured in this manner supplies driving voltage to the two lamps 80 and 80', wherein the driving voltage corresponds to the driving control signal applied to the base of the switching transistor $Q_1$.

For example, if the driving control signal inputted to the base of the switching transistor $Q_1$ is inputted as logic "high," the switching transistor $Q_1$ and the driver transistor $Q_2$ are both "turned on," so that the voltage drop of the emitter-collector voltage $V_{ec}$ is subtracted from the power source voltage $v_{cc}$, thereby supplying driving voltage "$V_{dc}=V_{cc}-V_{ec}$" to one side of each of the recess lamp 80 and the button lamp 80'. Consequently, the two lamps 80 and 80' are turned on with the maxim illumination.

If a pulsed driving control signal having an on/off duty ratio of 50% is outputted from the control unit 15, the switching transistor Q1 and the driver transistor Q2 are switched "on/off" in response to the pulsed driving control signal, whereby the effective voltage supplied to the recess lamp 80 and the button lamp 80' is reduced to about half (½) in level, as a result of which the illumination is also tuned to about ½ in level to be darker. Therefore, the luminous intensities of the lamps 80 and 80' are tuned according to the duty ratio of the driving control signal applied to the lamp driving unit 64 from the control unit 15.

Figure 10:
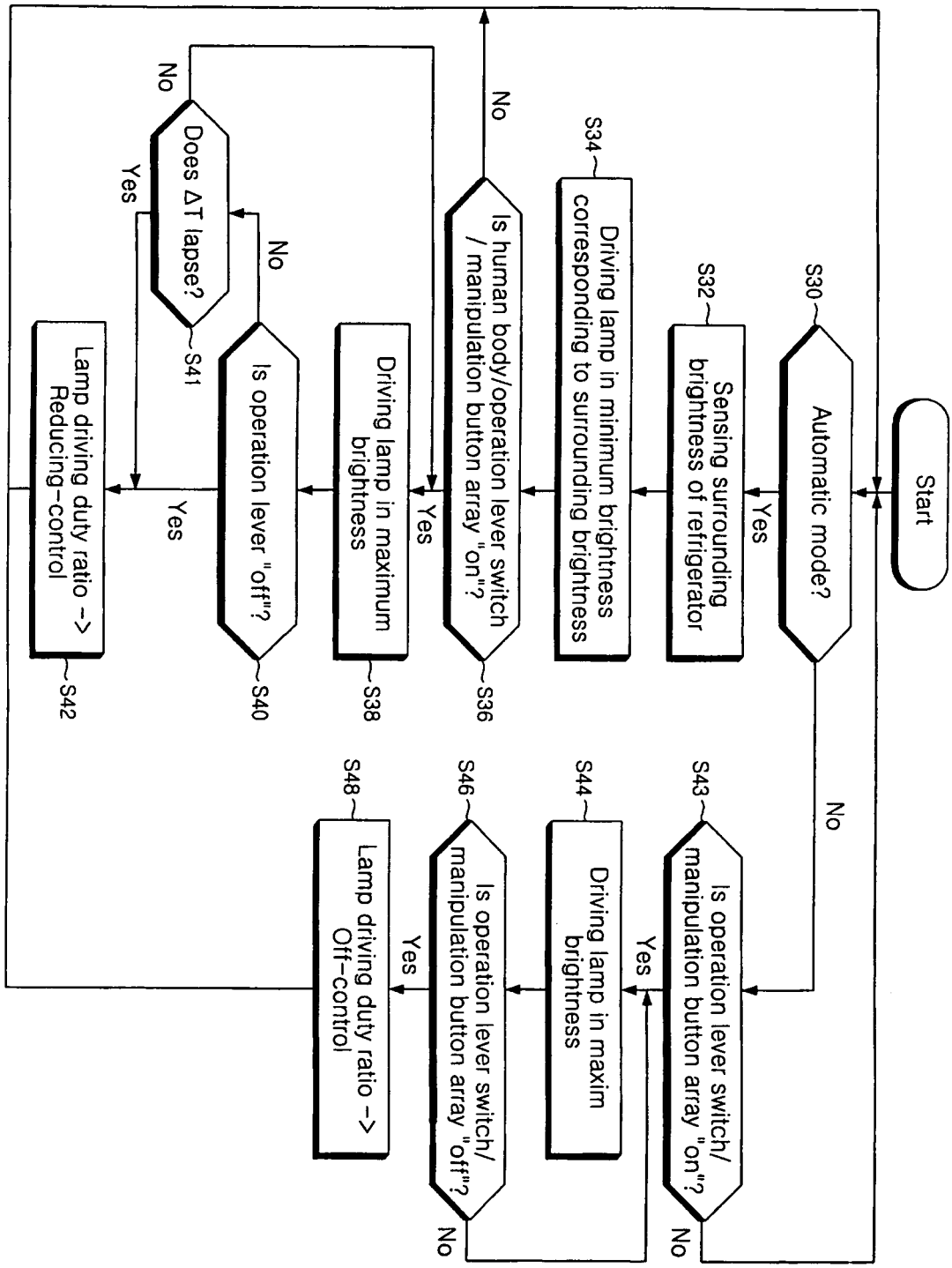
FIG. 10 is a flowchart for the lamp control apparatus of the refrigerator according to the third embodiment of the present invention.
Figure 11:
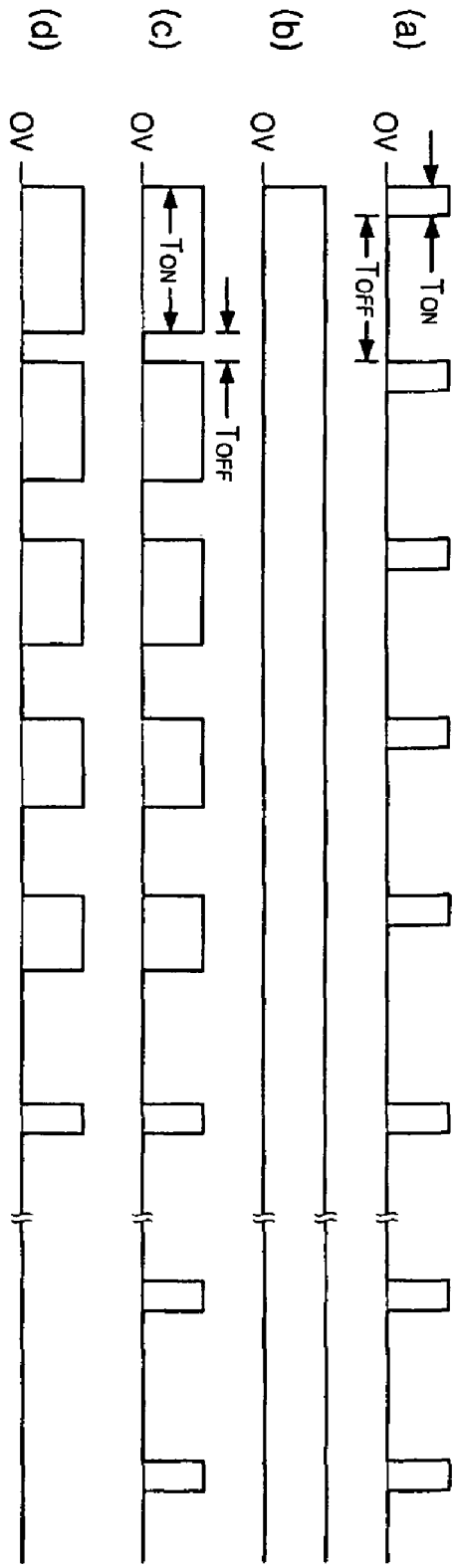
FIG. 11 shows waveforms for driving the lamp and button lamp shown in FIG. 9.

FIG. 10 is a flowchart of the refrigerator's lamp control process according to a preferred embodiment of the present invention, wherein the control process is programmed into a ROM area in the control unit 15 of FIG. 9, and FIG. 11 shows waveforms for driving the lamp and the button lamp shown in FIG. 9.

Now, the action of the third embodiment of the present invention is described in detail with reference to FIGS. 8 to 11.

When the lamp control apparatus shown in FIG. 8 is operated, the control unit 15 detects the switching condition of the mode switch 62 so as to determine whether it is in the automatic mode or not in step 30 of FIG. 10. For example, if the mode switch 62 is switched on, it means that the automatic mode is set, and if the mode switch 62 is switched off, it means that the automatic mode is released.

Here, "automatic mode" means that while the illumination is being maintained at a minimum level in normal times, if the pyroelectric sensor 64 detects a person around the refrigerator 10, the operation lever 8 of the dispenser 5 is operated by the user, or one or more manipulation buttons in the manipulation array 11 are selected, the lamps 80 and 80' are controlled to be in a maximum level in luminous intensity, and then if the operation lever 8 or the selection of the manipulation button array 11 is released, the two lamps 80 and 80' are adjusted to and continuously maintained in the minimum level in luminous intensity. In addition, the illumination condition controlled to be in the minimum level means that the luminous intensity is controlled to the extent for allowing the user to recognize the manipulation button array 11 and the recess 7 of the dispenser 5 in consideration of the surrounding brightness of the refrigerator, i.e., the brightness. Therefore, even if the recess lamp 80 and the button lamp 80' are turned off as the surrounding brightness of the refrigerator is very high due to sunlight, the condition of the lamps is also included in the illumination condition controlled to be in the minimum level. With this control, the user will easily use the dispenser 5 of the refrigerator even if the refrigerator is positioned in a dark place.

If the mode is determined as the automatic mode in step 30, the control unit reads the output of the illumination sensor 60' in step 32, and outputs a first driving mode signal, i.e., a lowest brightness driving control signal for driving the recess lamp 80 and the button lamp 80' with the minimum brightness corresponding to the surrounding brightness in step 34. For example, in the step 34 of FIG. 10, the control unit 15 supplies a pulsed driving control signal to the lamp driving unit 64 so as to drive the recess lamp 80 and the button lamp 80' with a voltage which is one tenth of the power source voltage $V_{cc}$, thereby keeping the brightness in the lowest level, wherein the pulse of the driving control signal, which has a period of 5 msec as shown in FIG. 11*a*, is set in such a manner that the duty ratio of turning-on and turning-off of the pulse is not more than 10%.

After driving the recess lamp 80 and the button lamp 80' connected to the recess lamp 80 in parallel in such a manner as to have the minimum luminous intensity during the above-mentioned process, in step 36, the control unit 15 monitors whether a human body is detected or the operation lever 8 or the manipulation button array 11 is operated. The detection of the human body is executed in such a manner that the pyroelectric sensor 63 supplies a human body detection signal to the control unit 15 when it detects the approach of the user. In addition, it determines whether the operation lever 8 or the manipulation buttons 11 is operated by reading the switched condition of the lever switch, which is switched in cooperation with the operation lever 8, and the manipulation button array 11.

If it is determined that no signal is inputted as the result of the above-mentioned detection, the control unit 15 repeats the operation from the step 30, so that the recess lamp 80 and the button lamp 80' are driven with the minimum brightness, thereby facilitating the use of the refrigerator during the nighttime.

However, in step 36, if it is determined that a person approaches the refrigerator or the operation lever 8 or the manipulation buttons 11 is operated, the control unit 15 outputs a driving control signal for the second driving mode, which has logic "high" as shown in FIG. 11*b*, to the switching transistor $Q_1$ of the lamp driving unit 64 in step 38.

Therefore, through the above-mentioned operation, the recess lamp 80 for illuminating the dispenser 5 and the button lamp 80' for illuminating the manipulation button array 11 are controlled to be lightened with the maximum brightness in the state in which the lamp control mode (nighttime mode) has been set as the automatic mode, so that the refrigerator can be efficiently used in a very dark environment.

In addition, in step 40, the control unit 15 determines whether the lever switch 61, which cooperates with the operation lever 8, and the manipulation button array 11 is in the "off" state. At this time, the lamp driving unit 64 outputs the maximum driving voltage to the recess lamp 80 and the button lamp 80' in response to the driving control signal of the logic "high," so that the lamps 80 and 80' are lightened with the maximum brightness.

If the user puts a cup into the dispenser 5 so as to operate the operation lever 8, thereby receiving water or ice from the discharge port and then takes the cup out of the recess 7, the lever switch 61, which is cooperated with the operation lever 8, is turned "off." At this time, the control unit 15 detects this in the step 40 of FIG. 10, outputs a driving control signal of a third driving mode, the duty ratio of which is gradually reduced during a previously set period of time as shown in FIG. 11*c*, and then continuously outputs a driving control signal for keeping the minimum brightness. At this time, it is preferable that the previously set length of time is about 5 sec, and the pulse of the driving signal has a period of 5 msec.

That is, the control unit 15 outputs a lamp driving control signal having initial logic "high," with the turning-on and turning-off ratio of 90:10, so that the turning-on and turning-off ratio is gradually reduced to 10:90, thereby minimizing the brightness of the recess lamp 80 and the button lamp 80'. With this control by the control unit 15, the voltage outputted from the lamp driving unit 64 is gradually reduced from the level of Vcc-Vec, so that the brightness of the recess lamp 80 and the button lamp 80' is tuned to be gradually darkened.

If the lever switch 61 is not turned "off" by the operation lever 8, the control unit 15 determines whether a predetermined length of time (for example, about 3 sec) has passed in step 41. If it is determined that the lever 8 is not operated 8, the control unit 15 executes the step 42, so that the brightness of the lamps 80 and 80' is tuned to be automatically darkened. This is performed so as to prevent the lamps 80 and 80' from being continuously lightened with the maximum brightness when a person merely passes by a refrigerator arranged in a home without doing anything.

Therefore, if the lamp control mode of the inventive refrigerator is set as the automatic mode, the surrounding of the recess 7 of the dispenser 5 and the manipulation button array 11 are illuminated by dim lights depending on the surrounding brightness, and when a person approaches the refrigerator, the recess lamp 80 and the button lamp 80' are driven with the maximum brightness, and then after the user receives water or ice, the brightness of the two lamps 80 and 80' is gradually darkened, so that the minimum brightness is maintained, whereby the refrigerator can be efficiently used during the nighttime.

If the user turns off the mode switch 62 so as to set the operation mode as the manual operation mode (daytime mode), in the step of FIG. 10, the control unit 15 determines that the operation mode is the manual operation mode, and in step 43, the control unit 15 detects whether the lever switch 61 and the manipulation button array 11 are turned on. As a result, if it is determined that the lever switch 61 and the manipulation button array 11 are not turned on, the control unit 15 returns to the step 30.

If the user puts cup into the recess 7 of the dispenser 5, thereby pushing the operation lever 8 so that the lever switch 61 is turned on or one or more manipulation buttons in the manipulation button array 11 are pressed, the control unit 15 outputs a driving control signal as shown in FIG. 11*b* to the lamp driving unit 64 in step 44, so that the recess lamp 80 and the button lamp 80' are lightened with the maximum brightness.

Thereafter, in step 46, the control unit 15 determines whether the lever switch 61 or the manipulation button array 11 is turned off. If it is determined that the lever switch 61 or the manipulation button array 11 is not turned off, the control unit 15 repeatedly performs the step 44, so that the brightness of the lightened lamps 80 and 80' is maintained at a maximum. If it is determined that the lever switch 61 and the manipulation button array 11 are turned off, the control unit 15 outputs a lamp driving control signal of the fourth driving move in the form of the pulse as shown in FIG. 11*d* so that the power source voltage supplied to the recess lamp 80 and the button lamp 80' is gradually lowered in level over a predetermined length of time and then turned off.

Referring to FIG. 11*d*, it will be appreciated that the lamp driving control signal is gradually lowered in duty ratio for a predetermined length of time $T_{operation}$ and then outputted as logic "low." Consequently, it will be appreciated that the voltage supplied to the recess lamp 80 and the button lamp 80' from the lamp driving unit 64 is gradually lowered until the lamps 80 and 80' is turned off.

Therefore, if the lamp control mode is set as the manual operation mode (daytime mode), the lamp control apparatus according to the third embodiment of the present invention drives the recess lamp 80 and the button lamp 80' in such a manner as to be lightened only when the user operates the operation lever 8 or the manipulation button array 11 positioned on the manipulation panel 13 on the door, and if the operation lever 8 or the manipulation button array 11 is released in such a manner as to be turned off, the brightness of the two lamps 80 and 80' is tuned to be gradually darkened and then the two lamps 80 are turned off, whereby power saving can be achieved during the daytime.

Although it has been described that the automatic mode and the manual mode are set by the mode switch 62 in the third embodiment of the present invention, it will be appreciated by one skilled in the art that the nighttime and the daytime are discriminated by the output of the illumination sensor 60', so that one of the two modes can be selected so as to tune the brightness of the lamps.

As described in detail above, according to the inventive apparatus and method for controlling a lamp of a refrigerator, the following effects can be achieved.

Firstly, a desired amount of ice or water can be received through a dispenser even during the dark of nighttime.

In addition, by comparing the luminous intensity around the refrigerator or the dispenser with a previously set reference luminous intensity, it is possible to selectively lighten the lamp and the reference luminous can be renewed, whereby the condition for lightening the lamp can be changed according to the surrounding environment or the user's taste.

Furthermore, while the refrigerator's lamp is maintained properly depending on the brightness around the refrigerator, the lamp is controlled to be in the maximum brightness when the user approaches the refrigerator or the operation lever or the manipulation button array is operated, and the lamp is controlled in such a manner that the brightness of the lamp is gradually darkened when the operation for taking out water or ice from the dispenser or the operation of the manipulation button array is completed, whereby the dispenser can be efficiently used. Occasionally, it is also possible to expect a power saving effect because the brightness of the lamp is controlled in such a manner as to be gradually darkened and then the lamp is turned off when the operation of the operation lever or the manipulation button array is completed.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. An apparatus for controlling a lamp of a refrigerator, comprising:

a dispenser provided on a refrigerator door, wherein the dispenser comprises:

an operation lever for adjusting a discharge amount of ice or water;

a rotary member that includes a rotary shaft supported by side walls of the dispenser and a connection part that extends from the rotary shaft, and a duct door, coupled to the connection part, for selectively opening and closing an ice duct based on movement of the rotary member and the duct door for being removably combined with the rotary member;

at least one lamp installed on a side of the rotary member to illuminate the dispenser, wherein the at least one lamp is installed on a surface of the rotary member to illuminate an inner side of the dispenser when the duct door closes the ice duct;

a sensor for sensing a surrounding brightness of the refrigerator;

a control unit for controlling on/off operation of the at least one lamp, wherein the control unit causes the rotary member to be swiveled in a direction, so that the ice duct is opened by the duct door when the operation lever is operated, wherein the control unit is capable of varying a driving control signal such that a brightness of the at least one lamp is changed in response to an output of the sensor; and a rotation restraint piece provided on a surface of the duct door to extend farther from the duct door higher than a height of the at least one lamp to prevent fracture of the at least one lamp when the duct door is opened.

2. An apparatus as claimed in claim 1, wherein the rotary member rotates by a predetermined angle as the operation lever provided in the dispenser is operated.

3. An apparatus as claimed in claim 1, wherein the dispenser further comprises a guide member for guiding ice from the ice duct, the guide member formed from a transparent material.

4. An apparatus as claimed in claim 1, wherein the control unit controls the on/off operation of the at least one lamp depending on operation of a manipulation button array provided at the dispenser.

5. An apparatus as claimed in claim 1, wherein the control unit controls the on/off operation of the at least one lamp when the operation lever is operated.

6. An apparatus as claimed in claim 1, wherein the at least one lamp is provided on the connection part of the rotary member.

7. An apparatus as claimed in claim 1, wherein the rotary member is formed in a "T" shape.

8. An apparatus as claimed in claim 1, wherein the brightness of the at least one lamp is tuned based on a duty ratio of the driving control signal.

9. An apparatus as claimed in claim 1, wherein the at least one lamp changes from a first brightness to a second brightness based on the output of the sensor, wherein the at least one lamp is on for both the first brightness and the second brightness.

10. An apparatus as claimed in claim 1, wherein the rotation restraint piece prevents the at least one lamp from being fractured as a result of forced contact with a surface of a recess.

11. An apparatus comprising:

a refrigerator door dispenser that includes:

an operation lever for adjusting a discharge amount of ice or water;

a rotary member that includes a rotary shaft supported by walls of the dispenser and a connector part that extends away from the rotary shaft, and a duct door, coupled to the rotary member, to selectively open and close an opening based on movement of the rotary member and to be removably combined with the rotary member, a lamp on the connector part of the rotary member to illuminate the dispenser, wherein the lamp illuminates an inner side of the dispenser when the duct door closes the opening;

a sensor for sensing a surrounding brightness of the refrigerator;

a control unit for controlling on/off operation of the lamp, wherein the control unit causes the rotary member to be swiveled in a direction, so that the ice duct is opened by the duct door when the operation lever is operated, wherein the control unit is capable of varying a driving control signal such that a brightness of the lamp is changed in response to an output of the sensor; and a rotation restraint piece provided on a surface of the duct door to extend from the duct door higher than a height of the lamp and to prevent fracture of the lamp when the duct door is opened.

12. An apparatus as claimed in claim 11, wherein the rotary member is formed in a "T" shape.

13. An apparatus as claimed in claim 11, wherein the dispenser further includes a guide member to guide ice from the opening, the guide member including a transparent material.

14. An apparatus as claimed in claim 11, wherein the rotation restraint piece extends further from the duct door than the lamp.

15. An apparatus as claimed in claim 11, wherein the control unit controls an on/off status of the lamp based on operation of a manipulation button array.

16. An apparatus as claimed in claim 11, wherein the control unit controls an on/off status of the lamp based on operation of the operation lever.

17. An apparatus as claimed in claim 11, wherein the brightness of the lamp is tuned based on a duty ratio of the driving control signal.

18. An apparatus as claimed in claim 11, wherein the lamp changes from a first brightness to a second brightness based on the output of the sensor, wherein the lamp is on for both the first brightness and the second brightness.

19. An apparatus as claimed in claim 11, wherein the rotation restraint piece to prevents the lamp from being fractured as a result of forced contact with a surface of a recess.

* * * * *